US009067303B2

(12) United States Patent
Hatou et al.

(10) Patent No.: US 9,067,303 B2
(45) Date of Patent: Jun. 30, 2015

(54) METHOD OF EXECUTING SHOT PEENING

(71) Applicant: Hitachi-GE Nuclear Energy Ltd., Hitachi-shi, Ibaraki (JP)

(72) Inventors: Hisamitu Hatou, Hitachi (JP); Noboru Saito, Kasumigaura (JP); Ren Morinaka, Takahagi (JP); Fujio Yoshikubo, Mito (JP); Masashi Fukaya, Kashiwa (JP); Yuji Matsui, Hitachinaka (JP); Ryuji Kimura, Hitachi (JP)

(73) Assignee: Hitachi-GE Nuclear Energy, Ltd., Hitachi-shi (JP)

( * ) Notice: Subject to any disclaimer, the term of this patent is extended or adjusted under 35 U.S.C. 154(b) by 318 days.

(21) Appl. No.: 13/926,068

(22) Filed: Jun. 25, 2013

(65) Prior Publication Data

US 2014/0000330 A1 Jan. 2, 2014

(30) Foreign Application Priority Data

Jun. 27, 2012 (JP) ..... 2012-143801

(51) Int. Cl.
*B24C 1/10* (2006.01)
*B24C 7/00* (2006.01)

(52) U.S. Cl.
CPC ..... *B24C 1/10* (2013.01); *B24C 7/0007* (2013.01)

(58) Field of Classification Search
CPC ..... B24C 1/10; B24C 7/007
USPC ..... 72/53; 451/37, 38, 39, 197; 427/198; 29/90.7
See application file for complete search history.

(56) References Cited

U.S. PATENT DOCUMENTS

| | | | | |
|---|---|---|---|---|
| 3,545,996 | A * | 12/1970 | Duncan | 427/198 |
| 3,675,452 | A * | 7/1972 | Osmolovsky et al. | 72/53 |
| 5,709,590 | A * | 1/1998 | McPhee et al. | 451/87 |
| 5,945,157 | A * | 8/1999 | Lee et al. | 427/198 |
| 5,950,469 | A * | 9/1999 | Tsuro et al. | 72/53 |
| 6,289,705 | B1 * | 9/2001 | Duquenne et al. | 72/53 |
| 6,490,899 | B2 * | 12/2002 | Berthelet et al. | 72/53 |
| 6,505,489 | B2 * | 1/2003 | Berthelet et al. | 72/53 |
| 6,508,093 | B2 * | 1/2003 | Berthelet et al. | 72/53 |
| 7,389,663 | B2 * | 6/2008 | Cheppe et al. | 72/53 |
| 7,644,599 | B2 * | 1/2010 | Hoffmann-Ivy et al. | 72/53 |

FOREIGN PATENT DOCUMENTS

| | | |
|---|---|---|
| JP | 2008-96174 A | 4/2008 |
| JP | 2011-56616 A | 3/2011 |

* cited by examiner

*Primary Examiner* — David B Jones
(74) *Attorney, Agent, or Firm* — Crowell & Moring LLP

(57) ABSTRACT

A chamber having a water jet generation apparatus and a mesh installed inside is pushed against a surface of a peening object. A rotary vane of the water jet generation apparatus, disposed in a region in the chamber between the mesh and the chamber, is rotated to generate a water jet flowing toward the peening object in one region in the chamber, the one region is a region closer to the peening object than the mesh. A plurality of shots 4 put in the region 30A moves toward the peening object along with the water jet and collides with the surface of the peening object. After the collision, the shots move toward the mesh along with the water jet. Compression residual stress is given to the surface of the peening object with which the shots have collided. Thus, spreading of contaminants peeled off from a peening object can be prevented.

10 Claims, 9 Drawing Sheets

METHOD OF EXECUTING SHOT PEENING

CLAIM OF PRIORITY

The present application claims priority from Japanese Patent application serial no. 2012-143801, filed on Jun. 27, 2012, the content of which is hereby incorporated by reference into this application.

BACKGROUND OF THE INVENTION

1. Technical Field

The present invention relates to a method of executing shot peening and, in particular, to a method of executing shot peening suitable for being applied to a method of executing shot peening using a water jet which converts tensile residual stress generated on a structural member into compressive residual stress to prevent stress corrosion cracking and to improve fatigue strength of the structural member.

2. Background Art

A method of executing shot peening using a water jet is stated in Japanese Patent Laid-open No. 2011-56616. In this method of executing shot peening, a chamber containing shots (ceramic or metal balls having 1 to 6 mm in diameters) is set on a surface of a structural member which is a peening object, and high-pressure water is ejected into the chamber from a nozzle provided to the chamber. The ejected high-pressure water generates a water jet in the chamber. The shots in the chamber are moved along with the water jet toward the surface of the structural member and hit against the surface of the structural member. Thus, the shot peening for the surface is executed and residual compressive stress is given to the surface of the structural member. The high-pressure water ejected into the chamber is drained outside the chamber from a drain slit formed in an end portion contacting the surface of the structural member.

CITATION LIST

Patent Literature

[Patent Literature 1] Japanese Patent Laid-open No. 2011-56616

SUMMARY OF THE INVENTION

Technical Problem

In the method of executing shot peening stated in Japanese Patent Laid-open No. 2011-56616, the ejection of the high-pressure water increases water quantity in the chamber, thus the water needs to be discharged from the drain slit. When the method of executing shot peening stated in Japanese Patent Laid-open No. 2011-56616 is applied to a structural member having a contaminated surface exposed to liquid, such as a structural member of a nuclear reactor or chemical plant, contaminants on the surface of the structural member is partially peeled off by collision of the shots and discharged outside the chamber through the drain slit along with the drainage. Consequently, the contaminants peeled off from the structural member may spread out to an area outside the chamber. Furthermore, since the high-pressure water ejected from the nozzle installed to the chamber is used to generate a water jet in the chamber, a relatively large high-pressure pump is needed to supply the high-pressure water. Thus, when the application site is spatially constrained, the method of executing shot peening stated in Japanese Patent Laid-open No. 2011-56616 will be difficult to be applied.

An object of the present invention is to provide a method of executing shot peening which can prevent spreading of contaminants peeled off from a peening object.

Solution to Problem

A feature of the present invention for attaining the above object comprises steps of bring an end portion of a chamber into contact with a surface of a peening object, the chamber having a water jet generation apparatus whose a rotary vane is disposed inside the chamber; generating a water jet in the chamber toward the surface of the peening object by rotating the rotary vane; and moving a plurality of shots put in the chamber toward the surface of the peening object by the water jet and making the shots collide with the surface of the peening object.

Since the rotary vane disposed in the chamber is rotated and the water jet that makes the shots collide with the surface of the peening object is generated, the water jet can be generated without increasing the water quantity in the chamber. Therefore, outflow of the water from the chamber can be suppressed and spreading of contaminants peeled off from the surface of the peening object by the collision of the shots, to the outside of the chamber can be suppressed. In addition, since the shots are made to collide with the surface of the peening object by the water jet, tensile residual stress on the surface of the peening object can be improved to compressive residual stress.

Advantageous Effect of the Invention

According to the present invention, spreading of contaminants peeled off from a peening object by executing shot peening can be suppressed.

DETAILED DESCRIPTION OF THE PREFERRED EMBODIMENTS

Embodiments of the present invention will be described below.

[Embodiment 1]

A method of executing shot peening according to embodiment 1, which is a preferred embodiment of the present invention, will be described with reference to FIG. 1.

Figure 1:
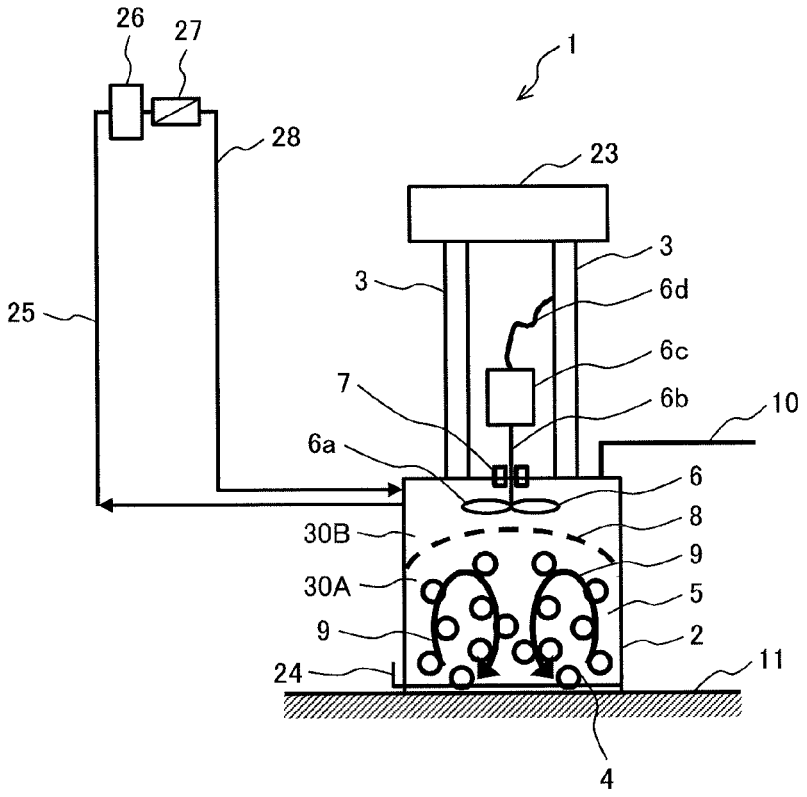
FIG. 1 is an explanatory drawing showing a method of executing shot peening according to embodiment 1, which is a preferred embodiment of the present invention.

The method of executing shot peening of the present embodiment uses a water jet stirring-type shot peening apparatus 1 shown in FIG. 1. The shot peening apparatus 1 has a chamber 2, a water jet generation apparatus 6, a mesh 8, and a makeup water supply pipe 10. One end of the chamber 2 is opened. Another end of the chamber 2 is closed and provided with a bearing 7. The bearing 7 is a watertight thrust bearing. The chamber 2 is 55 mm in inner diameter, 75 mm in outer diameter, and 50 mm in height, and is made of SUS316L (Japanese Industrial Standards) that is austenitic stainless steel.

The water jet generation apparatus 6 has a rotary vane 6*a*, a rotating shaft 6*b*, and an electric motor 6*c*.

The electric motor 6*c* is disposed outside the chamber 2 and installed to the chamber 2. The rotary vane 6*a* is disposed in the chamber 2 and installed to the rotating shaft 6*b*. The rotary vane 6*a* has four vanes made of austenitic stainless steel SUS304, 30 mm in diameter. The rotating shaft 6*b* is made of SUS304 (Japanese Industrial Standards) that is austenitic stainless steel, 6 mm in diameter, supported by the bearing 7, and coupled to a rotating shaft of the electric motor 6*c*. A cable 6*d* is connected to the electric motor 6*c*. The electric motor 6*c* is a 1 kW three-phase AC motor. The mesh 8 is disposed in the chamber 2 closer to the open end of the chamber 2 than the rotary vane 6*a*, and all the outer circumference of the mesh 8 is welded to the inner surface of the chamber 2. The mesh 8 forms numerous squares (through holes), each of which is 2 mm on a side. The mesh 8 has a curved surface of convex toward the rotary vane 6*a*. A makeup water supply pipe 10 is connected to the chamber 2. A shutter 24 is disposed near the open end of the chamber 2 and slidably installed to the chamber 2.

A pushing mechanism 3 is installed to a surface of the closed end of the chamber 2 to which the bearing 7 is provided. Additionally, the pushing mechanism 3 is set to a chamber moving apparatus (for example, a manipulator) 23. A filter apparatus (a purification apparatus) 27 is connected by a suction hose 25 to a side of the chamber 2 closer to the rotary vane 6*a* than the mesh 8, and further connected by a return hose 28 to the side of the chamber 2 closer to the rotary vane 6*a* than the mesh 8. A pump 26 is provided to the suction hose 25. A closed loop introducing with a region 30B, which is a region in the chamber 2 closer to the rotary vane 6*a* than the mesh 8, the suction hose 25, the filter apparatus 27, the return hose 28, and the region 30B is formed. While the shutter 24 is closed (while the open end of the chamber 2 is closed by the shutter 24), 190 shots 4 are put in a region 30A which is a region in the chamber 2 closer to the shutter 24 than the mesh 8. The shot 4 is a ball made of SUS316L, 4 mm in diameter. Each square formed in the mesh 8 is smaller than the size (for example, the diameter) of the shot 4.

A peening object 11 for which the method of executing shot peening according to embodiment 1 is executed is a weld portion of a V1 weld line of a core shroud made of stainless steel SUS316L, installed in a reactor pressure vessel of a boiling water reactor. The method of executing shot peening for the core shroud according to the present embodiment is executed after an operation shutdown of the boiling water reactor and, for example, during a periodic inspection of the boiling water reactor. After the operation shutdown of the boiling water reactor, a steam dryer, a steam separator, and fuel assemblies are sequentially taken out from the reactor pressure vessel. After all the fuel assemblies in the core are taken out from it, cooling water in the reactor pressure vessel is drained and then air atmosphere is formed in the reactor pressure vessel. The chamber 2 is moved by the chamber moving apparatus 23 into the core shroud in the reactor pressure vessel under air atmosphere, and while the shutter 24 of the chamber 2 is facing the core shroud, which is the peening object 11, the open end portion of the chamber 2 (hereinafter, referred to as the open end of the chamber 2) is pushed against the inner surface of the object, that is, the portion of the V1 weld line of the core shroud. A spring (not shown) of the pushing mechanism 3 gives a pushing force of 20 kgf to the chamber 2. Although the chamber 2 receives reactive force during shot peening by a water jet 9 to be described later, the pushing force of 20 kgf prevents the chamber 2 from lifting off during the shot peening.

After the open end of the chamber 2 is pushed against the inner surface of the core shroud, the shutter 24 is opened. The shutter 24 is opened or closed by an opening/closing mechanism (not shown). Although not shown in the Figure, the opening/closing mechanism has a motor, a ball screw, and a ball nut for example; the ball screw is coupled with the motor which is installed to the outer surface of the chamber 2, and the ball nut fixed to the shutter 24 is engaged with the ball screw. The motor turns the ball screw, which moves the shutter 24 for opening or closing.

Pure water 5 is supplied into the chamber 2 through the makeup water supply pipe 10 and the chamber 2 is filled with the pure water 5. When the chamber 2 is filled with the pure water 5, the pure water 5 is stopped from being supplied into the chamber 2 through the makeup water supply pipe 10. The outside of the chamber 2 is under air atmosphere. While the shutter 24 is open, the electric motor 6*c* is rotated. The rotating force of the electric motor 6*c* is transmitted to the rotary vane 6*a* through the rotating shaft 6*b* and the rotary vane 6*a* is rotated. By the rotation of the rotary vane 6*a*, the circulating water jet 9 is generated inside the chamber 2, and the shots 4 in the region 30A of the chamber 2 move along with the water jet 9 and collide with the inner surface of the portion (the peening object 11) with the V1 weld line of the core shroud covered by the chamber 2.

Due to the collision of the shots 4, the inner surface portion of the core shroud is pushed and stretched into plastic deformation. As a consequence, a base material part of the portion of the V1 weld line of the core shroud other than the inner surface portion hit by the shots 4 elastically restrains the portion pushed and stretched into plastic deformation, so that compressive stress is generated in the inner surface portion. The shots 4 collided with the inner surface portion of the core shroud and rebound from the collision, move along with the water jet 9 flowing from the inner surface portion of the core shroud to the mesh 8, turn around near the mesh 8 by the water jet 9 generated by the rotation of the rotary vane 6*a*, move toward the inner surface of the portion of the V1 weld line of the core shroud again, and collide with the inner surface. In this way, each shot 4 in the chamber 2 repeatedly collides with the inner surface of the portion of the V1 weld line of the core shroud and repeatedly moves toward the mesh 8 by the water jet 9 generated by the rotary vane 6*a*. The shot peening for the inner surface of the core shroud by the collision of the shots 4 is executed for approximately two minutes. Appropriate compressive residual stress can be given to the inner surface by executing the shot peening for the inner surface of the core shroud for about two minutes.

During the execution of the shot peening, the pure water 5 in the chamber 2 slightly leaks out from between the open end of the chamber 2 and the inner surface of the portion of the V1 weld line of the core shroud. The inside of the makeup water supply pipe 10 has the same pressure as the inside of the chamber 2, and when the pure water 5 in the chamber 2 leaks out from between the open end of the chamber 2 and the inner surface of the core shroud, reducing the pressure in the chamber 2, the pure water 5 is resupplied into the chamber 2 through the makeup water supply pipe 10.

The collision of the shots 4 causes some contaminants to peel off from the inner surface of the portion of the V1 weld line of the core shroud. The peeled contaminants are moved by drive of the pump 26 from the region 30A to the region 30B through the squares of mesh 8 along with the pure water 5 in the chamber 2 and further flow into the filter apparatus 27 through the suction hose 25. The filter apparatus 27 removes the contaminants flowed in and discharges the pure water 5. This pure water 5 returns to the chamber 2 through the return hose 28. In this way, as the pure water 5 in the chamber 2 circulates through the suction hose 25, the filter apparatus 27, the return hose 28, and the chamber 2, the contaminants in the chamber 2 are removed by the filter apparatus 27. Two filter apparatuses 27 are set up in parallel to the suction hose 25 and these filter apparatuses 27 are alternately used to remove contaminants. When the removal performance of one filter apparatus 27 is decreased by removal of contaminants, water is stopped from being passed to the filter apparatus 27 with decreased removal performance and the filter in the filter apparatus 27 is changed to a new one.

When it is finished to give compressive residual stress to the above inner surface of the core shroud, covered by the chamber 2, the electric motor 6*c* is stopped to stop the rotation of the rotary vane 6*a*. Then, the shutter 24 is closed to seal the open end of the chamber 2, and the chamber 2 is moved slightly away from the inner surface of the core shroud by the chamber moving apparatus 23. This chamber 2 is moved along the inner surface to a site next to the inner surface of the core shroud to which the compressive residual stress has been given. The chamber 2 is pushed against the surface of the core shroud by the pushing mechanism 3 at this location and the shutter 24 is opened. Then, as described above, the pure water 5 is supplied into the chamber 2 through the makeup water supply pipe 10, and the rotary vane 6*a* is rotated to generate the water jet 9. Compressive residual stress is given by the collision of the shots 4 to the inner surface of the portion of the V1 weld line of the core shroud, covered by the chamber 2. In this way, compressive residual stress is sequentially given to the inner surface of the portion of the V1 weld line of the core shroud.

Figure 2:
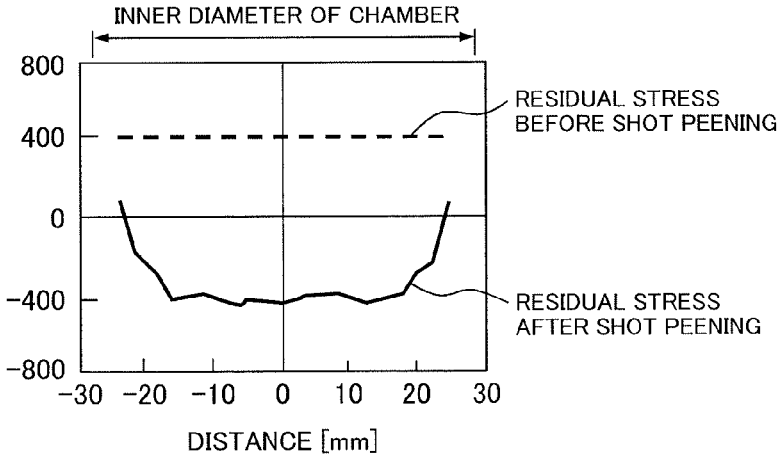
FIG. 2 is an explanatory drawing showing an effect of stress improvement in a structural member applied with a method of executing shot peening according to embodiment 1 shown in FIG. 1.

In order to check the compressive residual stress given to the inner surface of the portion of the V1 weld line of the core shroud by the method of executing shot peening according to the present embodiment, the inventors executed the shot peening as described above using the shot peening apparatus 1 for a flat test piece made of stainless steel SUS316L simulating the form of the portion of the V1 weld line of the core shroud, which is the peening object 11. This shot peening was executed while the outside of the chamber 2 was exposed to an air environment. The test piece is a flat plate having dimensions of 200 mm by 200 mm by 10 mm in thickness. In order to give the tensile residual stress found on the surface of the core shroud before the execution of the shot peening according to the present embodiment, the inventors applied grinding work in advance to the surface of the test piece for which the shot peening according to the present embodiment is to be executed. Therefore, a tensile residual stress of 400 MPa shown in a broken line in FIG. 2 was given on the surface. As a result of executing the method of executing shot peening according to the present embodiment described above using the shot peening apparatus 1 for the test piece, a compressive residual stress of approximately −400 MPa shown in a solid line in FIG. 2, can be given to the surface of the test piece. The residual stress generated on the test piece was measured by an X-ray residual stress measuring device.

In this way, a tensile residual stress of 400 MPa before the execution of the shot peening according to the present embodiment can be improved to a compressive residual stress of about −400 MPa on the inner surface of the portion of the V1 weld line of the core shroud, which is the peening object 11, by executing the shot peening according to the present embodiment. Such a stress improvement effect is sufficient enough for preventing stress corrosion cracking.

Furthermore, the inventors executed the method of executing shot peening according to the present embodiment described above. In this method, another flat test piece made of SUS316L having dimensions of 200 mm by 200 mm by 10 mm in thickness, which is the same as the above test piece, was immersed in water and then the shot peening apparatus 1 was used for the test piece in water. As a result, residual compressive stress shown in a solid line in FIG. 2 was given to the surface of the test piece in the same manner as the above test piece.

The test pieces for which separately shot peening according to the present embodiment described above were executed with the outside of the chamber 2 disposed both in an air environment and in a water environment were each immersed in boiling 42% magnesium chloride solution to test for stress corrosion cracking. As a result, no stress corrosion cracking was found on the surface of each test piece whose tensile residual stress has been improved to compressive residual stress.

Unlike Japanese Patent Laid-open No. 2011-56616 in which high-pressure water supplied from outside is ejected into a chamber to generate a water jet toward a peening object, since in the present embodiment, the rotary vane 6*a* of the water jet generation apparatus 6 is rotated and the water jet 9 in the chamber 2 to make the shots 4 collide with the surface of the peening object 11 is generated, the water jet 9 can be generated without increasing the water quantity in the chamber 2 and the pure water 5 in the chamber 2 can be significantly reduced from flowing outside the chamber 2. The amount of the pure water 5 leaked out from the chamber 2 during the execution of the method of executing shot peening according to the present embodiment was measured; as a result, it was confirmed that the leak rate of the water was approximately 5 $cm^3$ in two minutes per one site for executing the shot peening. This leak rate is less than 5% of 110 $cm^3$ which is the inner volume of the chamber 2. Thus, the present embodiment significantly reduces the amount of contaminants peeled off from the surface of the core shroud by the collision of the shots 4 and flowed out to the environment outside the chamber 2, that is, into the reactor pressure vessel, and prevents spreading of the contaminants in the reactor pressure vessel.

The mesh 8 is disposed in front of the rotary vane 6*a*, that is, at a border between the region 30A and the region 30B in the chamber 2, so that the shots 4 circulated by the water jet 9 are prevented from colliding with the rotary vane 6*a*. This can prevent damage to the rotary vane 6*a*. In addition, since the openable/closable shutter 24 is provided to the open end of the chamber 2, the open end of the chamber 2 can be closed by the shutter 24 when the chamber 2 needs to be moved to change a surface of the peening object 11 to execute the shot peening. Thus, the closed shutter 24 can prevent the shots 4 in the chamber 2 from falling out of the chamber 2 when the chamber 2 is moved.

The method of executing shot peening according to the present embodiment described above using the shot peening apparatus 1 for the surface of the core shroud was executed while the outside of the chamber 2 was exposed to an air environment. However, it can be executed for the inner surface of the portion of the V1 weld line of the core shroud while the reactor pressure vessel is filled with cooling water, by moving the chamber 2 in the cooling water in the reactor pressure vessel using the chamber moving apparatus 23 and pushing the chamber 2 against the inner surface of the core shroud covered by the chamber 2. In this case, a watertight electric motor 6*c* is used as the electric motor 6*c* of the water jet generation apparatus 6. When the method of executing shot peening according to the present embodiment described above using the shot peening apparatus 1 is executed in water for the inner surface of the portion of the V1 weld line of the core shroud, which is the peening object 11, each effect resulted by the method of executing shot peening executed in an air environment described above can be obtained. The method of executing shot peening according to the present embodiment described above using the shot peening apparatus 1 can be executed in water while the reactor pressure vessel is filled with cooling water, so that radiations released from reactor internals of the reactor pressure vessel can be shielded by the cooling water filled in the reactor pressure vessel, which eliminates the need of providing a radiation shield.

[Embodiment 2]

Figure 3:
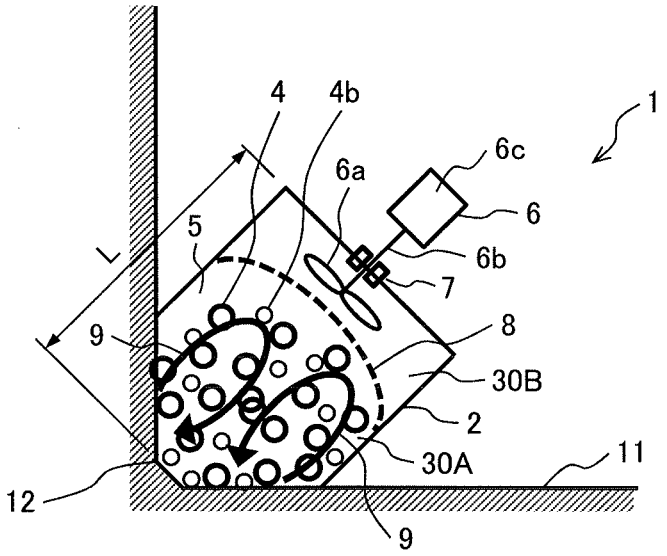
FIG. 3 is an explanatory drawing showing a method of executing shot peening according to embodiment 2, which is another preferred embodiment of the present invention.

A method of executing shot peening according to embodiment 2, which is another preferred embodiment of the present invention, will be described with reference to FIG. 3. The method of executing shot peening according to the present embodiment is executed, for example, for a fillet weld portion such as an H3 weld line of a core shroud installed in a reactor pressure vessel of a boiling water reactor.

The method of executing shot peening according to the present embodiment executed, for example, for the fillet weld portion of the core shroud, which is a peening object 11 having a fillet weld portion 12, uses the shot peening apparatus 1 practically used in embodiment 1. The shot peening apparatus 1 used in the present embodiment is different from the shot peening apparatus 1 used in embodiment 1 in the size of the chamber 2, the size of squares formed in the mesh 8, and the number and the size of shots used in the chamber 2, but its structure is practically the same as the shot peening apparatus 1 used in embodiment 1.

Only the components of the shot peening apparatus 1 used in the present embodiment which are different from the shot peening apparatus 1 used in embodiment 1 will be described. The shot peening apparatus 1 used in the present embodiment has a chamber 2 having dimensions of 55 mm in inner diameter, 75 mm in outer diameter, and 40 mm in height; and a mesh 8 provided in the chamber 2 has squares each of which is 0.5 mm on a side. In addition, the shot peening apparatus 1 used in the present embodiment has 100 shots 4 made of stainless steel SUS316L, 4 mm in diameter, and 100 shots 4*b* made of SUS316L, 1 mm in diameter, put in a region 30A in the chamber 2. The other components of the shot peening apparatus 1 used in the present embodiment are the same as those of the shot peening apparatus 1 used in embodiment 1.

After an operation shutdown of the boiling water reactor, for example, during a periodic inspection, the chamber 2, in the same manner as embodiment 1, is moved by the chamber moving apparatus 23 in the reactor pressure vessel under air atmosphere (or cooling water) atmosphere, to a location of the fillet weld portion 12 on the core shroud, which is the peening object 11. The chamber 2 facing the fillet weld portion 12 on the core shroud is pushed against the core shroud by the chamber moving apparatus 23 and the pushing mechanism 3. The chamber 2 has a certain shape so that all surface of the open end of the chamber 2 comes in contact with the surface of the core shroud including the fillet weld portion 12 when the chamber 2 is pushed against the core shroud. When the chamber 2 is pushed against the core shroud, the maximum length L between the fillet weld portion 12 and the end surface of the chamber 2 to which the bearing 7 is installed is 60 mm.

Before the shot peening is executed, the pure water 5 is supplied into the chamber 2 through the makeup water supply pipe 10 to fill the chamber 2 with the pure water 5. The area outside the chamber 2 in the reactor pressure vessel is under air (or cooling water) atmosphere. The electric motor 6*c* is driven to rotate the rotary vane 6*a*, and the water jet 9 is generated in the region 30A in the chamber 2. Due to the water jet 9, the shots 4 and 4*b* hit against the surface of the core shroud covered by the chamber 2, which is the peening object 11, particularly the surface of the fillet weld portion 12. The shots 4 and 4*b* repeatedly collide with the surface of the core shroud including the fillet weld portion 12 and repeatedly move toward the mesh 8 in the region 30A.

In the present embodiment, the region 30A in the chamber 2 is filled with the shots 4 (4 mm in diameter) and the shots 4*b* (1 mm in diameter) which are smaller than the shot 4. Consequently, the shots 4*b* collide with the surface of the fillet weld portion 12 where the shots 4 cannot hit, and plastic deformation by pushing and stretching occurs in the surface portion of the fillet weld portion 12. The surfaces of the core shroud on both sides of the fillet weld portion 12 are hit by the shots 4 and 4*b*. As a result, compressive residual stress is given to the surfaces of the core shroud covered by the chamber 2 including the surface of the fillet weld portion 12.

In the same manner as embodiment 1, the chamber 2 is moved along the fillet weld portion 12, and the shot peening is executed for a different site of the fillet weld portion 12.

Figure 4:
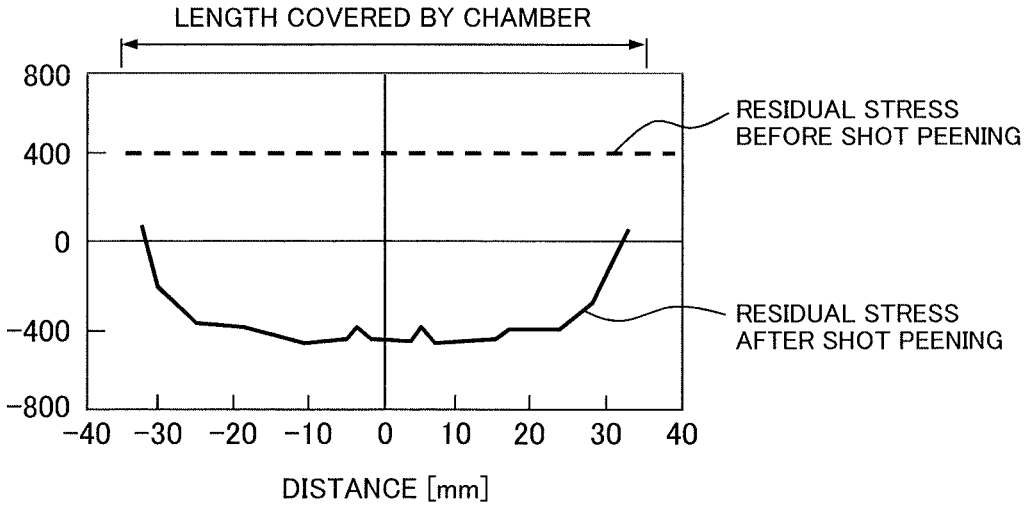
FIG. 4 is an explanatory drawing showing an effect of stress improvement in a structural member applied with a method of executing shot peening according to embodiment 2 shown in FIG. 3.

In order to check the compressive residual stress given to the surface of the core shroud including the fillet weld portion 12 by the method of executing shot peening according to the present embodiment, the inventors executed the shot peening as described above using the shot peening apparatus 1 for a test piece made of stainless steel SUS316L simulating the form of the fillet weld portion of the H3 weld line, for example, of the core shroud. This shot peening was executed while the outside of the chamber 2 was under air atmosphere. The test piece was prepared by orthogonally disposing two flat plates each of which was 200 mm by 200 mm by 10 mm in thickness, and fillet welding the flat plates. In the same manner as the flat test piece described in embodiment 1, the inventors applied grinding work to the surface of the test piece, for which the shot peening according to the present embodiment is to be executed, to give a tensile residual stress of 400 MPa shown in a broken line in FIG. 4. As a result of executing the method of executing shot peening according to the present embodiment described above using the shot peening apparatus 1 for the test piece, a compressive residual stress of approximately −400 MPa, as shown in a solid line in FIG. 4, can be given to the surface of the test piece in a range of ±30 mm on both sides from the center of the fillet weld portion 12.

In this way, a tensile residual stress of 400 MPa before the execution of the shot peening according to the present embodiment can be improved to a compressive residual stress of about −400 MPa on the inner surface of the core shroud including the fillet weld portion 12, which is the peening object 11, by executing the shot peening according to the present embodiment. In particular, the compressive residual stress can be given even to the surface of the fillet weld portion 12 by using the shots 4*b*.

In addition, as a result of measuring the amount of the pure water 5 leaked out from the inside of the chamber 2 to the outside thereof, it was confirmed that the leak rate was only about 7 $cm^3$ in two minutes per a site for executing the shot peening.

The present embodiment can obtain each effect generated in embodiment 1.

The method of executing shot peening according to the present embodiment can be executed even by immersing the chamber 2 in cooling water with the reactor pressure vessel filled with the cooling water.

[Embodiment 3]

A method of executing shot peening according to embodiment 3, which is other preferred embodiment of the present invention, will be described with reference to FIG. 5. The method of executing shot peening according to the present embodiment is executed, for example, for an outer surface of a riser pipe which is disposed in a reactor pressure vessel of a boiling water reactor. The riser pipe made of SUS316L is communicated with a jet pump disposed in the reactor pressure vessel. The jet pump and the riser pipe are disposed in an annular downcomer formed between a core shroud and the reactor pressure vessel.

Figure 5:
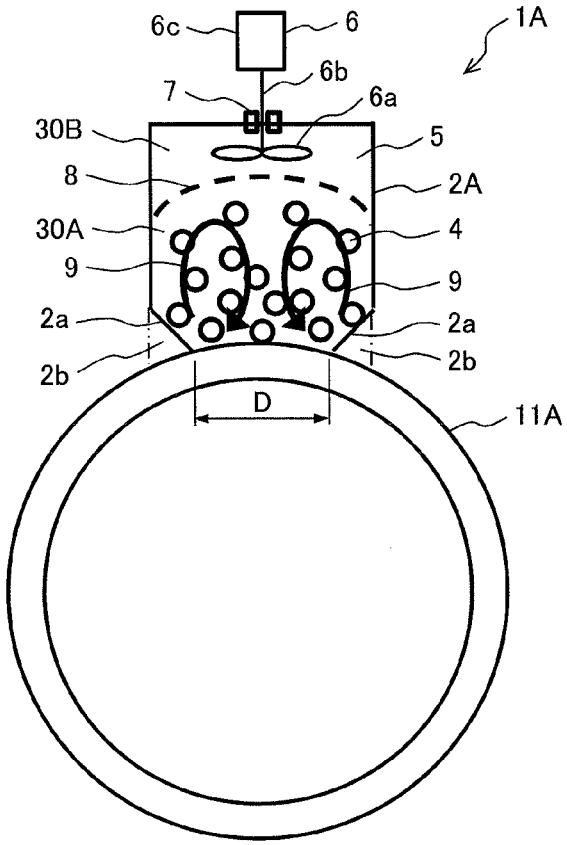
FIG. 5 is an explanatory drawing showing an a method of executing shot peening according to embodiment 3, which is other preferred embodiment of the present invention.

The method of executing shot peening according to the present embodiment executed, for example, for the outer surface of the riser pipe, which is a peening object 11A, uses a shot peening apparatus 1A shown in FIG. 5. The shot peening apparatus 1A has a structure of the shot peening apparatus 1 used in embodiment 1 except that the chamber 2 is replaced with a chamber 2A. The other structures of the shot peening apparatus 1A are the same as the shot peening apparatus 1 used in embodiment 1. The chamber 2A has a cylindrical taper portion 2*a* at the open end portion of the chamber 2. The outer diameter of the taper portion 2*a* is reduced toward its end.

The inner diameter D at the end of the taper portion 2*a* of the chamber 2A is 40 mm. The other dimensions of the chamber 2A having the taper portion 2*a* are the same as the chamber 2 of the shot peening apparatus 1. The end of the taper portion 2*a* has a curved surface with a curvature which allows all the circumference of the taper portion 2*a* to come in contact with the outer surface of the riser pipe, which is the peening object 11A.

After an operation shutdown of the boiling water reactor, for example, during a periodic inspection, the chamber 2A of the shot peening apparatus 1A is gone down by the chamber moving apparatus 23 in the downcomer in the reactor pressure vessel without cooling water, and moved to the outer surface of the riser pipe disposed in the downcomer. The end of the taper portion 2*a* of the chamber 2A is pushed against the outer surface of the riser pipe by the chamber moving apparatus 23 and the pushing mechanism 3.

After the pure water 5 is supplied into the chamber 2A through the makeup water supply pipe 10, the rotary vane 6*a* is rotated to generate the water jet 9 in the region 30A in the chamber 2A. Due to the water jet 9, the shots 4 hit against the outer surface of the riser pipe, which is the peening object 11A, covered by the chamber 2A. The shots 4 repeatedly collide with the outer surface of the riser pipe and repeatedly move toward the mesh 8 in the region 30A. After the shot peening is executed for two minutes at one site of the outer surface of the riser pipe, the chamber 2A is moved by the chamber moving apparatus 23 in the circumferential direction of the riser pipe and the method of executing shot peening according to the present embodiment is executed at a different site of the outer surface of the riser pipe in the circumferential direction. The shot peening is executed for the entire circumference of the outer surface of the riser pipe. After the shot peening for the entire circumference is completed, the chamber 2A is moved in the axial direction of the riser pipe to execute the shot peening at a difference site in the axial direction. The shot peening such as this is executed to give compressive residual stress is given to the outer surface of the riser pipe by executing the shot peening such as this.

Figure 6:
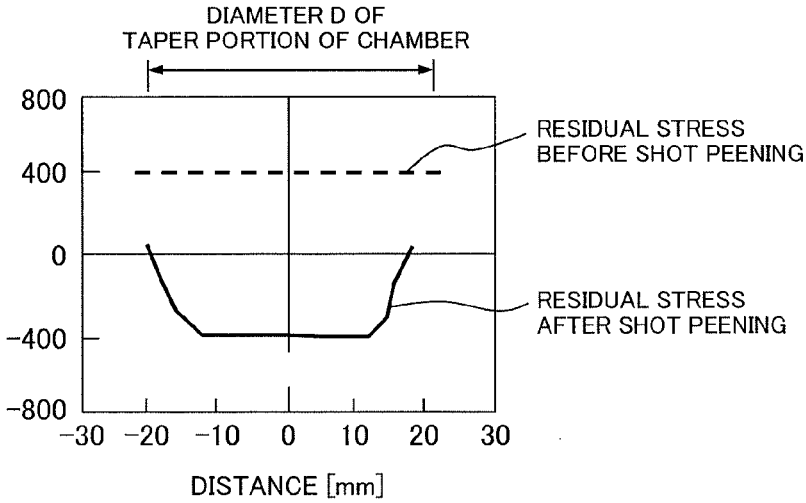
FIG. 6 is an explanatory drawing showing an effect of stress improvement in a structural member applied with a method of executing shot peening according to embodiment 3 shown in FIG. 5.

In order to check the compressive residual stress given to the outer surface of the riser pipe by the method of executing shot peening according to the present embodiment, the inventors executed the shot peening as described above using the shot peening apparatus 1A for an outer surface of a cylindrical test piece made of SUS316L, 300 mm in outer diameter, simulating the riser pipe. This shot peening was executed while the outside of the chamber 2 was under air atmosphere. In the same manner as the flat test piece described in embodiment 1, the inventors applied grinding work to the outer surface of the test piece, for which the shot peening of the present embodiment is to be executed, to give a tensile residual stress of 400 MPa shown in a broken line in FIG. 6. As a result of executing the method of executing shot peening according to the present embodiment described above using the shot peening apparatus 1A for the test piece, a compressive residual stress of approximately −400 MPa, as shown in a solid line in FIG. 6, can be given to the outer surface of the test piece in a range of ±15 mm on both sides from the center of the chamber 2A.

In this way, a tensile residual stress of 400 MPa before the execution of the shot peening according to the present embodiment can be improved to a compressive residual stress of about −400 MPa on the outer surface of the riser pipe, which is the peening object 11, by executing the shot peening according to the present embodiment.

In addition, as a result of measuring the amount of the pure water 5 leaked out from the inside of the chamber 2A to the outside thereof, it was confirmed that the leak rate was only about 4 $cm^3$ in two minutes per a site for executing the shot peening.

The present embodiment can obtain each effect generated in embodiment 1. If the chamber 2A has no taper portion 2*a* and has a cylindrical shape with the same inner diameter all through to the open end, the shots 4 and 4*b* will be accumulated in a region 2*b* near the open end (an area in the chamber 2A closer to the riser pipe than the taper portion 2*a*). The chamber 2A has the taper portion 2*a* to prevent such accumulation of the shots 4 and 4*b* in the chamber.

The method of executing shot peening according to the present embodiment can be executed for the outer surface of the riser pipe even by immersing the chamber 2 in cooling water with the reactor pressure vessel filled with cooling water.

[Embodiment 4]

Figure 7:
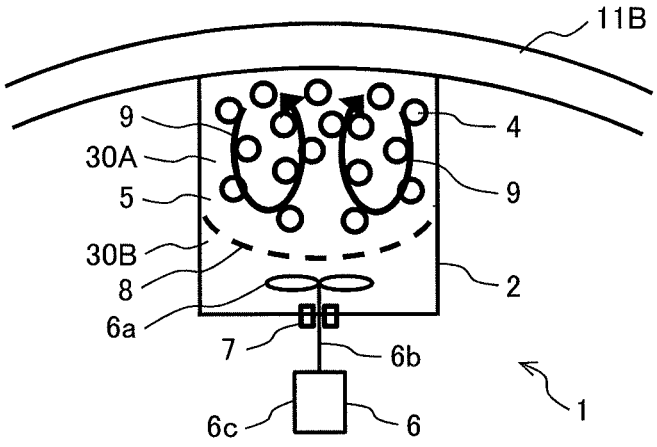
FIG. 7 is an explanatory drawing showing a method of executing shot peening according to embodiment 4, which is other preferred embodiment of the present invention.

A method of executing shot peening according to embodiment 4, which is other preferred embodiment of the present invention, will be described with reference to FIG. 7. The method of executing shot peening according to the present embodiment is executed, for example, for an inner surface of a portion of an H4 weld line of a core shroud, which is a peening object 11B, installed in a reactor pressure vessel of a boiling water reactor. The portion of the H4 weld line of the core shroud is cylindrical.

The method of executing shot peening according to the present embodiment executed for an inner surface of a weld portion of a H4 weld line of the core shroud uses the shot peening apparatus 1 used in embodiment 1.

After an operation shutdown of the boiling water reactor, for example, during a periodic inspection, the chamber 2 is moved in the same manner as embodiment 1 by the chamber moving apparatus 23 in the reactor pressure vessel under air atmosphere, and moved to a location of the inner surface of the weld portion of the H4 weld line of the core shroud, which is the peening object 11B. The chamber 2 is pushed against the inner surface of the core shroud by the chamber moving apparatus 23 and the pushing mechanism 3.

After the pure water 5 is supplied into the chamber 2 through the makeup water supply pipe 10, the rotary vane 6*a* is rotated to generate the water jet 9 in the region 30A in the chamber 2. Due to the water jet 9, the shots 4 hit against the inner surface of the weld portion of the H4 weld line of the core shroud, which is the peening object 11B, covered by the chamber 2. The shots 4 repeatedly collide with the inner surface of the weld portion of the H4 weld line and repeatedly move toward the mesh 8 in the region 30A. After the shot peening is executed for two minutes at one site of the inner surface of the weld portion of the H4 weld line of the core shroud, the chamber 2 is moved by the chamber moving apparatus 23 in the circumferential direction of the core shroud and the method of executing shot peening according to the present embodiment is executed at a different site of the inner surface of the weld portion of the H4 weld line of the core shroud. The shot peening is executed for the entire circumference of the inner surface with the H4 weld line. The compressive residual stress is given to the inner surface of the weld portion of the H4 weld line of the core shroud by executing the shot peening such as this.

Figure 8:
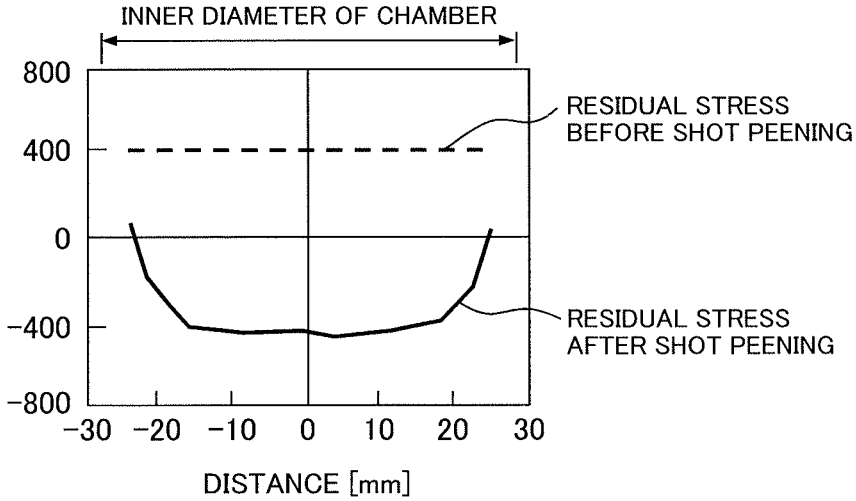
FIG. 8 is an explanatory drawing showing an effect of stress improvement in a structural member applied with a method of executing shot peening according to embodiment 4 shown in FIG. 7.

In order to check the compressive residual stress given to the inner surface of the weld portion of the H4 weld line of the core shroud by the method of executing shot peening according to the present embodiment, the inventors executed the shot peening as described above using the shot peening apparatus 1 for an inner surface of an arc-like test piece made of SUS316L, 2500 mm in radius and 50 mm in thickness, simulating the portion of the H4 weld line. This shot peening was executed while the outside of the chamber 2 was under air atmosphere. In the same manner as the flat test piece described in embodiment 1, the inventors applied grinding work to the inner surface of the test piece, for which the shot peening of the present embodiment is to be executed, to give a tensile residual stress of 400 MPa shown in a broken line in FIG. 8. As a result of executing the method of executing shot peening according to the present embodiment described above using the shot peening apparatus 1 for the inner surface of the test piece, a compressive residual stress of approximately −400 MPa, as shown in a solid line in FIG. 8, can be given to the inner surface of the test piece in a range of ±20 mm on both sides from the center of the chamber 2.

In this way, a tensile residual stress of 400 MPa before the execution of the shot peening according to the present embodiment can be improved to a compressive residual stress of about −400 MPa on the inner surface of the weld portion of the H4 weld line of the core shroud, which is the peening object 11B, by executing the shot peening according to the present embodiment.

In addition, as a result of measuring the amount of the pure water 5 leaked out from the chamber 2, it was confirmed that the leak rate was only about 5 $cm^3$ in two minutes per a site for executing the shot peening.

The present embodiment can obtain each effect generated in embodiment 1.

The method of executing shot peening according to the present embodiment can be executed even by immersing the chamber 2 in cooling water with the reactor pressure vessel filled with cooling water.

[Embodiment 5]

Figure 9:
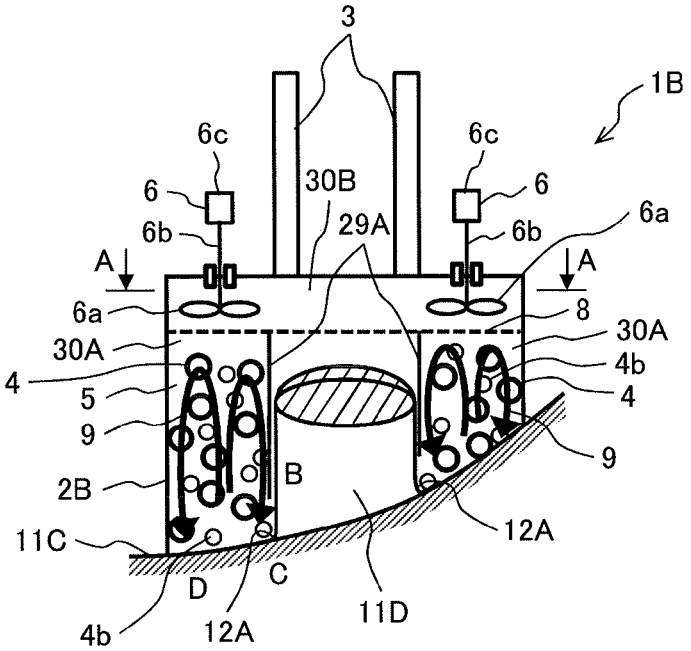
FIG. 9 is an explanatory drawing showing a method of executing shot peening according to embodiment 5, which is other preferred embodiment of the present invention.
Figure 10:
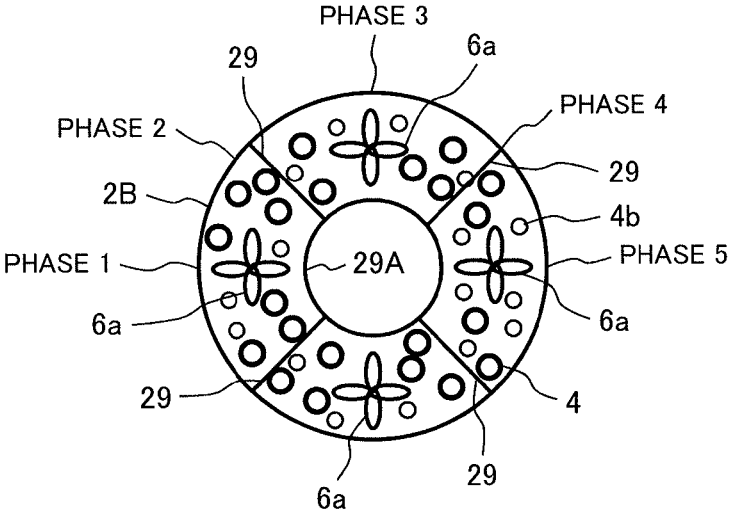
FIG. 10 is a cross-sectional view taken along A-A line of a chamber shown in FIG. 9.

A method of executing shot peening according to embodiment 5, which is other preferred embodiment of the present invention, will be described with reference to FIGS. 9 and 10. The method of executing shot peening according to the present embodiment is executed, for example, for the vicinity of an inner surface of a weld portion 12A between a bottom head of a reactor pressure vessel and a control rod drive mechanism stub (hereinafter, referred to as a CRD stub) in a reactor pressure vessel of a boiling water reactor. The bottom head and the CRD stub are made of 600 series Ni-based alloy (Japanese Industrial Standards). The present embodiment has two peening objects, which are the bottom head of the reactor pressure vessel as a peening object 11C and the CRD stub as a peening object 11D. The CRD stub is cylindrical.

A shot peening apparatus 1B used in the method of executing shot peening according to the present embodiment has a structure of the shot peening apparatus 1 used in embodiment 1 except that the chamber 2 is replaced with a chamber 2B, a plurality division members 29 and a cylindrical division member 29A are added, and a plurality of (for example, four) water jet generation apparatuses 6 are provided. The other structures of the shot peening apparatus 1B are the same as the shot peening apparatus 1. Each water jet generation apparatus 6 used in the shot peening apparatus 1B has the same structure as the water jet generation apparatus 6 used in the shot peening apparatus 1.

An open end of the chamber 2B is formed so as to match with the form of an inner surface of the bottom head and to allow the entire circumference of the open end to come in contact with the inner surface of the bottom head of the reactor pressure vessel. The mesh 8 dividing a region in the chamber 2B into the region 30A and the region 30B is installed to the inner surface of the chamber 2B and has numerous squares each of which is 0.5 mm on a side. The cylindrical division member 29A surrounding a CRD stub and the plurality of division members 29 radially arranged around the division member 29A are disposed in the region 30A formed between a top of the chamber 2B and the mesh 8. The top of the chamber 2B is come into contact with the bottom head. An upper end of the division member 29A is fixed to the mesh 8, and four division members 29 extending radially from the division member 29A toward the inner surface of the chamber 2B are disposed between the division member 29A and the inner surface of the chamber 2B. The division members 29 and 29A are made of SUS316L. Both end portions of each division member 29 in the radial direction of the chamber 2B are each fixed with the inner surface of the chamber 2B and the outer surface of the division member 29A. The four plate-like division members 29 divide the annular region formed between the chamber 2B and the division member 29A into four regions in the circumferential direction of the chamber 2B (see FIG. 10). Since the chamber 2B surrounds the CRD stub and the four regions are formed in the chamber 2B, the inner volume of the chamber 2B is larger than that of the chamber 2 in the shot peening apparatus 1.

The four water jet generation apparatuses 6 are each installed to the chamber 2B on the opposite side of the open end of the chamber 2B. The rotary vane 6*a* of each water jet generation apparatus 6 is disposed in the region 30B above the mesh 8 directly above each of the four regions divided by the division members 29.

Shots 4 and 4*b* made of 600 series Ni-based alloy are put in each of the four regions divided by the division members 29 in the region 30A to prevent impurities to be mixed in. Two hundred shots 4, each 4 mm in diameter, and two hundred shots 4*b*, each 1 mm in diameter, are put in each of the four regions. The shots 4*b* are added so that, in the same manner as embodiment 2, compressive residual stress can be given to the inner surface of the weld portion 12A which is a fillet weld portion between the CRD stub and the bottom head of the reactor pressure vessel.

After an operation shutdown of the boiling water reactor, for example, during a periodic inspection, the chamber 2B, in the same manner as embodiment 1, is moved by the chamber moving apparatus 23 in the reactor pressure vessel under air atmosphere, and come down to a reactor bottom area in the reactor pressure vessel. Further, the chamber 2B is come down until it surrounds the CRD stub, which is the peening object 11D, and touches the inner surface of the bottom head, which is the peening object 11C. When the open end of the chamber 2B comes in contact with the inner surface of the bottom head, the chamber 2B is pushed against the inner surface of the bottom head of the reactor pressure vessel by the chamber moving apparatus 23 and the pushing mechanism 3. In the present embodiment, the chamber 2B having a large inner volume is pushed against the inner surface of the bottom head by a spring of the pushing mechanism 3 with a pushing force of 40 kgf. At this time, the division member 29A provided in the chamber 2B surrounds the CRD stub except for the vicinity of the weld portion 12A.

After the pure water 5 is supplied into the chamber 2B through the makeup water supply pipe 10 to fill the four regions in the region 30A and the region 30B with the pure water 5, each rotary vane 6*a* of the four water jet generation apparatuses 6 is rotated to generate the water jet 9 in each of the four regions in the region 30A. The shots 4 and 4*b* along with the water jet 9 hit against the inner surfaces of the bottom head and the weld portion 12A in the four regions divided by the division members 29. The shots 4 and 4*b* repeatedly collide with the inner surface of the bottom head or the weld portion 12A and repeatedly move toward the mesh 8 in each of the regions in the region 30A. The method of executing shot peening according to the present embodiment is executed for two minutes for the inner surfaces of the weld portion 12A and the bottom head of the reactor pressure vessel in the vicinity of the weld portion 12. The compressive residual stress can be given to the inner surface of the lower cover and the weld portion 12A by the shot peening such as this.

Figure 11:
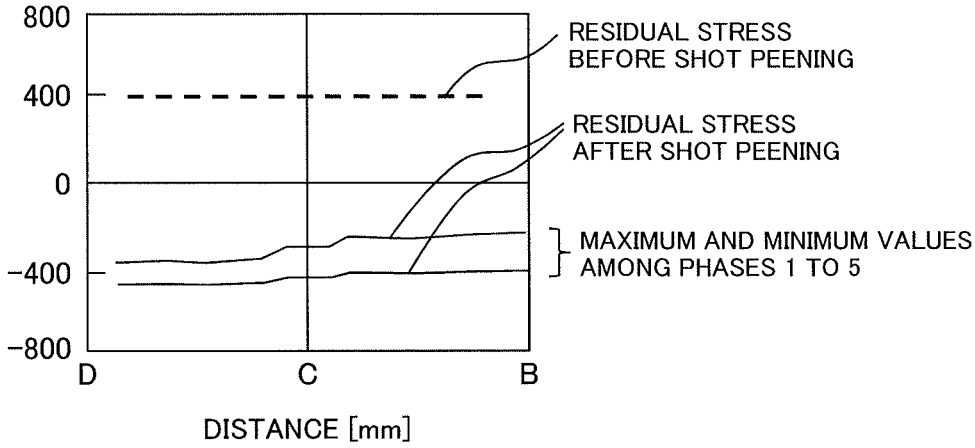
FIG. 11 is an explanatory drawing showing an effect of stress improvement in a structural member applied with a method of executing shot peening according to embodiment 5 shown in FIG. 9.

In order to check the compressive residual stress given to the inner surfaces of the weld portion 12A and the bottom head in the vicinity of the weld portion 12A by the method of executing shot peening according to the present embodiment, the inventors executed the shot peening as described above using the shot peening apparatus 1B for inner surfaces of a weld portion 12A and a bottom head of a test piece made of 600 series Ni-based alloy simulating the bottom head of the reactor pressure vessel and the CRD stub installed to the bottom head. This shot peening was executed while the chamber 2B was under air atmosphere. In the same manner as the flat test piece described in embodiment 1, the inventors applied grinding work to the inner surfaces of the weld portion 12A and the bottom head of the test piece, for which the shot peening of the present embodiment is to be executed, to give a tensile residual stress of 400 MPa shown in a broken line in FIG. 11. As a result of executing the method of executing shot peening according to the present embodiment described above for the inner surfaces of the test piece using the shot peening apparatus 1B, compressive residual stress was given, as shown in solid lines in FIG. 11, to the inner surfaces of the test piece at a level of approximately −300 MPa even at a site with the least stress improvement effect among phases 1 to 5. The phases 1 to 5, as shown in FIG. 10, are regions in the chamber 2B facing the regions formed by each division member 29.

In this way, a tensile residual stress of 400 MPa before the execution of the shot peening according to the present embodiment can be improved to a compressive residual stress of at least −300 MPa on the inner surface of the weld portion 12A between the bottom head, which is the peening object 11C, and the CRD stub, which is the peening object 11D, and the inner surface of the bottom head in the vicinity of the weld portion 12A, by executing the shot peening according to the present embodiment.

In addition, as a result of measuring the amount of the pure water 5 leaked out from the inside of the chamber 2B to the outside thereof, the leak rate was approximately 20 $cm^3$ in two minutes per a site for executing the shot peening. This leak rate is less than 5% of 500 $cm^3$ which is the inner volume of the chamber 2B.

The present embodiment can obtain each effect generated in embodiment 1. The division members 29 can be installed to evenly distribute the shots 4 and 4*b* in the region 30A, and to evenly give compressive residual stress to the inner surfaces of the bottom head and the weld portion 12A.

The method of executing shot peening according to the present embodiment can be executed even by immersing the chamber 2B in cooling water with the reactor pressure vessel filled with cooling water.

[Embodiment 6]

Figure 12:
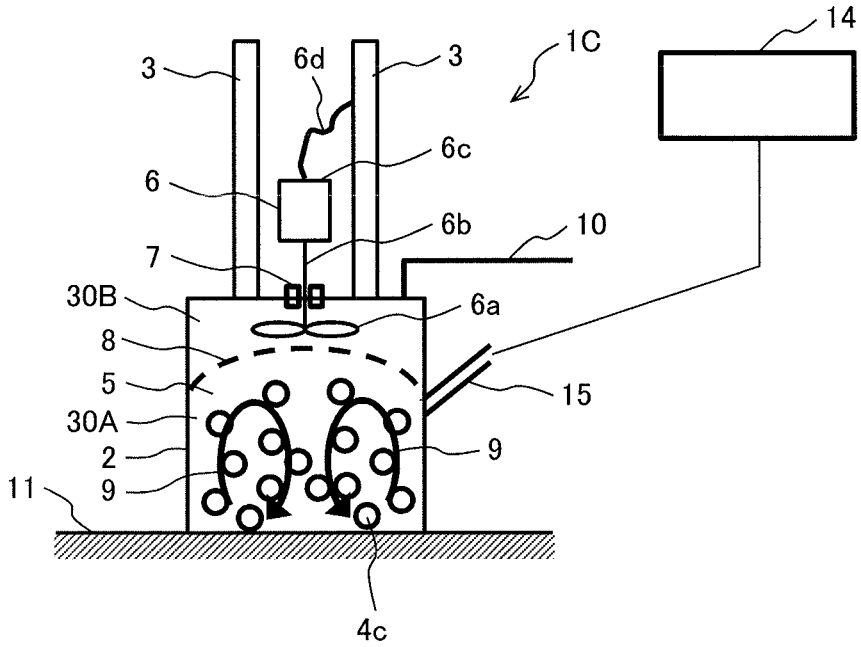
FIG. 12 is an explanatory drawing showing a method of executing shot peening according to embodiment 6, which is other preferred embodiment of the present invention.

A method of executing shot peening according to embodiment 6, which is other preferred embodiment of the present invention, will be described with reference to FIG. 12. The method of executing shot peening according to the present embodiment is executed, in the same manner as embodiment 1, for the inner surface of the weld portion of the V1 weld line of a core shroud installed in a reactor pressure vessel of a boiling water reactor. A peening object 11 in the present embodiment is the portion of the V1 weld line of the core shroud. A shot peening apparatus 1C used in the method of executing shot peening according to the present embodiment has a structure of the shot peening apparatus 1 used in embodiment 1 to which an ice-making apparatus 14 and an ice supply pipe 15 are added. The other structures of the shot peening apparatus 1C are the same as the shot peening apparatus 1.

The ice supply pipe 15 connected to ice-making apparatus 14 is connected to the chamber 2 and communicated with the region 30A in the chamber 2. In the method of executing shot peening according to the present embodiment, ice particles 4*c* are used instead of metal shots. This ice particle 4*c* is a kind of shot.

After an operation shutdown of the boiling water reactor, for example, during a periodic inspection, the chamber 2 of the shot peening apparatus 1C is come down by the chamber moving apparatus 23 in the core shroud in the reactor pressure vessel without cooling water, and moved to an inner surface of a weld portion of the V1 weld line of the core shroud. Then, the open end of the chamber 2 is pushed against the inner surface of the weld portion of the V1 weld line of the core shroud by the chamber moving apparatus 23 and the pushing mechanism 3.

The pure water 5 is supplied into the chamber 2 through the makeup water supply pipe 10, and the ice particles 4*c* made by the ice-making apparatus 14 are supplied into the region 30A in the chamber 2 through the ice supply pipe 15. The diameter of the ice particle 4*c* is approximately 10 mm. The ice particles 4*c* are supplied into the chamber 2 from the ice supply pipe 15 at a supply rate of 30 $cm^3$/min. After the pure water 5 and the ice particles 4*c* are supplied into the chamber 2, the rotary vane 6*a* is rotated to generate the water jet 9 in the region 30A in the chamber 2. Due to the water jet 9, the ice particles 4*c* hit against the inner surface of the weld portion of the V1 weld line of the core shroud, which is the peening object 11, covered by the chamber 2. The ice particles 4*c* repeatedly collide with the inner surface of the weld portion of the V1 weld line of the core shroud and repeatedly move toward the mesh 8 in the region 30A. After the shot peening is executed for two minutes at one site of the inner surface of the weld portion of the V1 weld line, the chamber 2 is moved by the chamber moving apparatus 23 in the circumferential direction of the core shroud and the method of executing shot peening according to the present embodiment is executed at a different site of the inner surface of the weld portion of the V1 weld line of the core shroud in the circumferential direction. The compressive residual stress can be given to the inner surface of the weld portion of the V1 weld line of the core shroud by this shot peening using the ice particles 4*c*. The ice particles 4*c* melt while they circulate along with the water jet 9 in the region 30A in the chamber 2 and eventually disappear, but new ice particles 4*c* made by the ice-making apparatus 14 can be supplied into the region 30A in the chamber 2.

Figure 13:
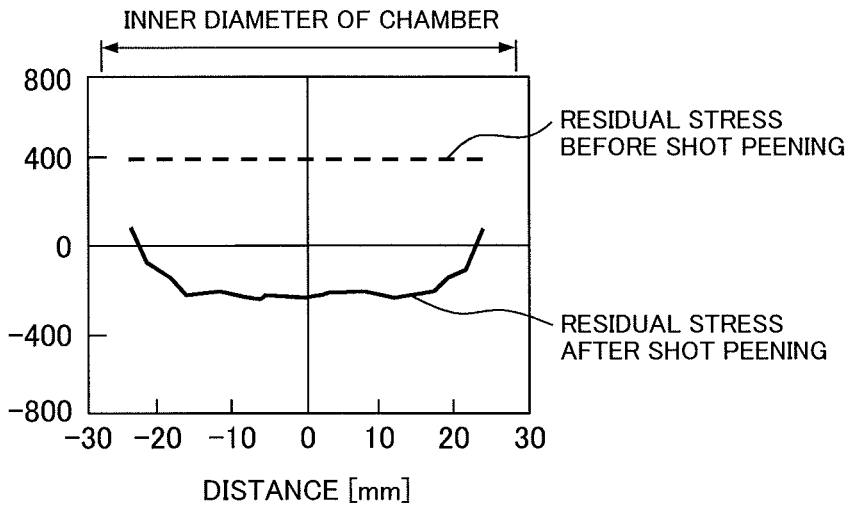
FIG. 13 is an explanatory drawing showing an effect of stress improvement in a structural member applied with a method of executing shot peening according to embodiment 6 shown in FIG. 12.

In order to check the compressive residual stress given to the inner surface of the weld portion of the V1 weld line of the core shroud by the method of executing shot peening according to the present embodiment, the inventors executed the shot peening as described above using the shot peening apparatus 1C for an inner surface of a flat test piece made of SUS316L simulating the form of the weld portion of the V1 weld line of the core shroud. This shot peening was executed while the outside of the chamber 2 was under air atmosphere. The test piece is a flat plate with dimensions of 200 mm by 200 mm by 10 mm in thickness. In the same manner as the flat test piece described in embodiment 1, the inventors applied grinding work to the surface of the test piece, for which the shot peening according to the present embodiment is to be executed, to give a tensile residual stress of 400 MPa shown in a broken line in FIG. 13. As a result of executing the method of executing shot peening according to the present embodiment described above using the shot peening apparatus 1C for the test piece, a compressive residual stress of approximately −200 MPa, as shown in a solid line in FIG. 13, can be given to the surface of the test piece in a range within a radius of 20 mm from the center of the chamber 2.

In this way, a tensile residual stress of 400 MPa before the execution of the shot peening according to the present embodiment can be improved to the compressive residual stress of about −200 MPa on the inner surface of the weld portion of the V1 weld line, which is the peening object 11, by executing the shot peening according to the present embodiment.

The present embodiment can obtain each effect generated in embodiment 1. Furthermore, the present embodiment uses the ice particles 4*c* instead of the metal shots 4. If by any chance the metal shots 4 spill out of the chamber 2 into the reactor pressure vessel, the spilled shots 4 need to be recovered from the reactor pressure vessel. If a reactor operation is started while the spilled shots are there, the shots 4 remained in the reactor pressure vessel could move along with the flow of cooling water in the reactor pressure vessel and collide with reactor internals of the reactor pressure vessel or fuel assemblies loaded in the core and damage them. In order to avoid this, the spilled metal shots 4 need to be recovered as described above, but the recovery operation of the shots 4 having small diameters increases the shutdown period of the nuclear reactor. In the present embodiment using the ice particles 4*c* instead of the metal shots 4, even when the ice particles 4*c* spill out of the chamber 2 into the reactor pressure vessel during the shot peening operation, the ice particles 4*c* will melt into water, so that damage to the reactor internals of the reactor pressure vessel and the fuel assemblies by the ice particles 4*c* spilled into the reactor pressure vessel can be prevented.

The method of executing shot peening according to the present embodiment can be executed even by immersing the chamber 2 in cooling water with the reactor pressure vessel filled with cooling water.

[Embodiment 7]

Figure 14:
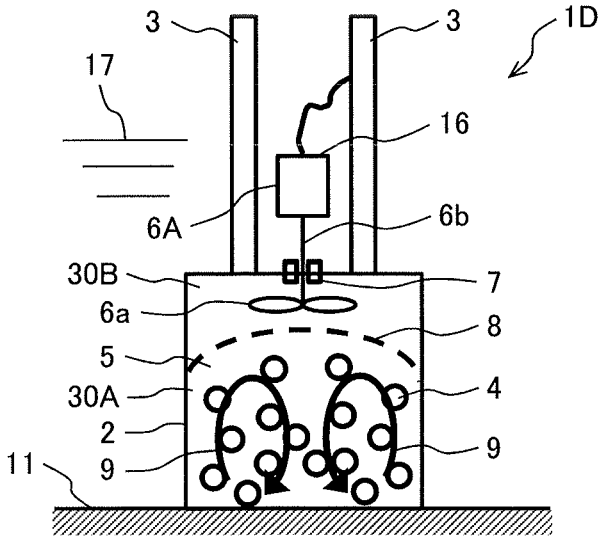
FIG. 14 is an explanatory drawing showing a method of executing shot peening according to embodiment 7, which is other preferred embodiment of the present invention.

A method of executing shot peening according to embodiment 7, which is other preferred embodiment of the present invention, will be described with reference to FIG. 14. The method of executing shot peening according to the present embodiment is executed, in the same manner as embodiment 1, for the inner surface of the weld portion of the V1 weld line of the core shroud, which is a peening object 11, installed in the reactor pressure vessel of the boiling water reactor. A shot peening apparatus 1D used in the method of executing shot peening according to the present embodiment has a structure of the shot peening apparatus 1 used in embodiment 1 except that the water jet generation apparatus 6 is replaced with a water jet generation apparatus 6A and the makeup water supply pipe 10 is removed. The other structures of the shot peening apparatus 1D are the same as the shot peening apparatus 1. The water jet generation apparatus 6A has a structure of the water jet generation apparatus 6 except that the electric motor 6*c* is replaced with a watertight air motor 16. The other structures of the water jet generation apparatus 6A are the same as the water jet generation apparatus 6.

After an operation shutdown of the boiling water reactor, for example, during a periodic inspection, the chamber 2 of the shot peening apparatus 1D is come down by the chamber moving apparatus 23 in the core shroud in the reactor pressure vessel filled with cooling water 17, and moved to the inner surface of the weld portion of the V1 weld line of the core shroud. Then, the open end of the chamber 2 is pushed against the inner surface of the weld portion of the V1 weld line of the core shroud by the chamber moving apparatus 23 and the pushing mechanism 3.

The chamber 2 is filled with the cooling water 17, so the air motor 16 is driven to rotate the rotary vane 6*a* and the water jet 9 is generated in the region 30A in the chamber 2. Due to the water jet 9, the shots 4 hit against the inner surface of the weld portion of the V1 weld line of the core shroud, which is the peening object 11, covered by the chamber 2. The shots 4 repeatedly collide with the inner surface of the weld portion of the V1 weld line of the core shroud and repeatedly move toward the mesh 8 in the region 30A. After the shot peening is executed for two minutes at one site of the inner surface of the weld portion of the V1 weld line of the core shroud, the chamber 2 is moved by the chamber moving apparatus 23 in the circumferential direction of the core shroud and the method of executing shot peening according to the present embodiment is executed at a different site of the inner surface of the weld portion of the V1 weld line of the core shroud.

Figure 15:
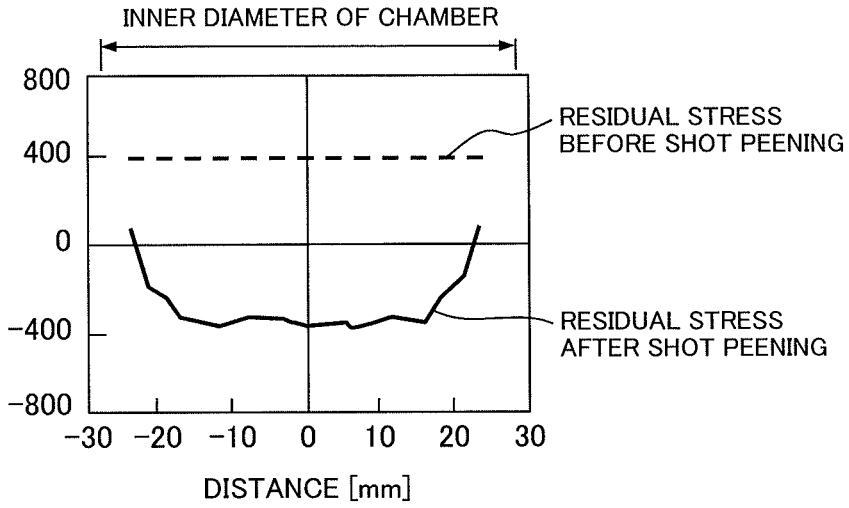
FIG. 15 is an explanatory drawing showing an effect of stress improvement in a structural member applied with a method of executing shot peening according to embodiment 7 shown in FIG. 14.

In order to check the compressive residual stress given to the inner surface of the weld portion of the V1 weld line of the core shroud by the method of executing shot peening according to the present embodiment, the inventors executed the shot peening as described above using the shot peening apparatus 1D for a surface of a flat test piece made of SUS316L simulating the form of the weld portion of the V1 weld line of the core shroud. This shot peening was executed while the test piece was immersed in water and the chamber 2 was pushed against the surface of the test piece in water. The test piece is a flat plate with dimensions of 200 mm by 200 mm by 10 mm in thickness. In the same manner as the flat test piece described in embodiment 1, the inventors applied grinding work to the surface of the test piece, for which the shot peening according to the present embodiment is to be executed, to give a tensile residual stress of 400 MPa shown in a broken line in FIG. 15. As a result of executing the method of executing shot peening according to the present embodiment described above using the shot peening apparatus 1D in water for the test piece, a compressive residual stress of approximately −400 MPa, as shown in a solid line in FIG. 15, can be given to the surface of the test piece in a range within a radius of 20 mm from the center of the chamber 2.

In this way, a tensile residual stress of 400 MPa before the execution of the shot peening according to the present embodiment can be improved to the compressive residual stress of about −400 MPa on the inner surface of the weld portion of the V1 weld line, which is the peening object 11, by executing the shot peening according to the present embodiment.

The present embodiment can obtain each effect generated in embodiment 1. Since the method of executing shot peening according to the present embodiment is executed in water, radiations released from structures in the reactor pressure vessel can be shielded by the cooling water 17 filled in the reactor pressure vessel and no other radiation shield is required separately.

When the electric motor 6*c* is used and if by any chance electric leakage in water occurs, there is a fear of human accident and damage to existing sensors installed in the reactor pressure vessel. The present embodiment using the air motor 16 can eliminate such fear. Furthermore, the shot peening apparatus 1D is simplified because no makeup water supply pipe 10 is needed.

[Embodiment 8]

Figure 16:
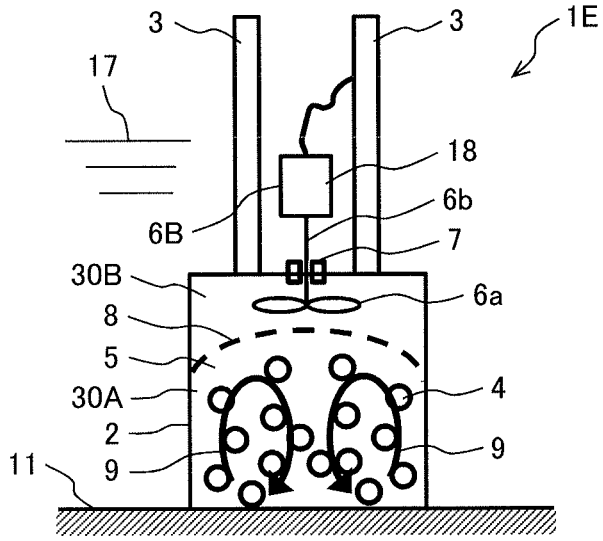
FIG. 16 is an explanatory drawing showing a method of executing shot peening according to embodiment 8, which is other preferred embodiment of the present invention.
Figure 17:
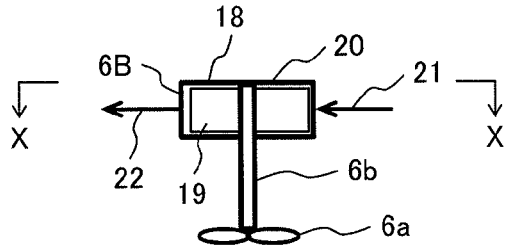
FIG. 17 is a longitudinal sectional view showing a water jet motor shown in FIG. 16.
Figure 18:
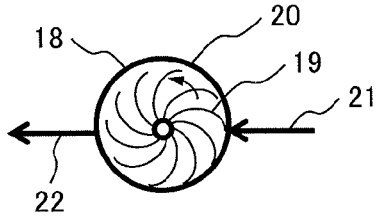
FIG. 18 is a cross-sectional view taken along X-X line of a water jet motor shown in FIG. 17.

A method of executing shot peening according to embodiment 8, which is other preferred embodiment of the present invention, will be described with reference to FIGS. 16, 17, and 18. The method of executing shot peening according to the present embodiment is executed, in the same manner as embodiment 1, for the inner surface of the weld portion of the V1 weld line of the core shroud, which is a peening object 11, installed in the reactor pressure vessel of the boiling water reactor. A shot peening apparatus 1E used in the method of executing shot peening according to the present embodiment has a structure of the shot peening apparatus 1 used in embodiment 1 except that the water jet generation apparatus 6 is replaced with a water jet generation apparatus 6B. The other structures of the shot peening apparatus 1E are the same as the shot peening apparatus 1. The water jet generation apparatus 6B has a structure of the water jet generation apparatus 6 except that the electric motor 6*c* is replaced with a water jet motor 18. The other structures of the water jet generation apparatus 6B are the same as the water jet generation apparatus 6.

The structure of the water jet motor 18 will be described with reference to FIGS. 17 and 18. The water jet motor 18 has an impeller 19 disposed in a casing 20 and a rotating shaft 6*b* is coupled with the impeller 19. The rotating shaft 6*b* penetrates the casing 20 and extends to the outside. A driving water supply hose 21 is connected to the casing 20 and a driving water drain hose 22 is connected to the casing 20. A rotary vane 6*a* is installed to the rotating shaft 6*b* at the inside of the casing 20.

The water jet motor 18 of the water jet generation apparatus 6B is installed to the opposite side of the open end of the chamber 2. The rotary vane 6*a* is disposed in the region 30B in the chamber 2.

After an operation shutdown of the boiling water reactor, for example, during a periodic inspection, the chamber 2 of the shot peening apparatus 1E is come down by the chamber moving apparatus 23 in the core shroud in the reactor pressure vessel filled with the cooling water 17, and moved to the inner surface of the weld portion of the V1 weld line of the core shroud. Then, the open end of the chamber 2 is pushed against the inner surface of the weld portion of the V1 weld line of the core shroud by the chamber moving apparatus 23 and the pushing mechanism 3.

The chamber 2 is filled with the cooling water 17, so driving water is supplied into the casing 20 through the driving water supply hose 21. The driving water is discharged from the casing 20 to the driving water drain hose 22. The impeller 19 in the casing 20 is rotated by the supply of the driving water to rotate the rotary vane 6*a*. The rotation of the rotary vane 6*a* generates the water jet 9 in the region 30A in the chamber 2. Due to the water jet 9, the shots 4 hit against the inner surface of the weld portion of the V1 weld line of the core shroud, which is the peening object 11, covered by the chamber 2. The shots 4 repeatedly collide with the inner surface of the weld portion of the V1 weld line of the core shroud and repeatedly move toward the mesh 8 in the region 30A. After the shot peening is executed for two minutes at one site of the inner surface of the weld portion of the V1 weld line of the core shroud, the chamber 2 is moved by the chamber moving apparatus 23 in the circumferential direction of the core shroud and the method of executing shot peening according to the present embodiment is executed at a different site of the inner surface of the weld portion of the V1 weld line of the core shroud.

Figure 19:
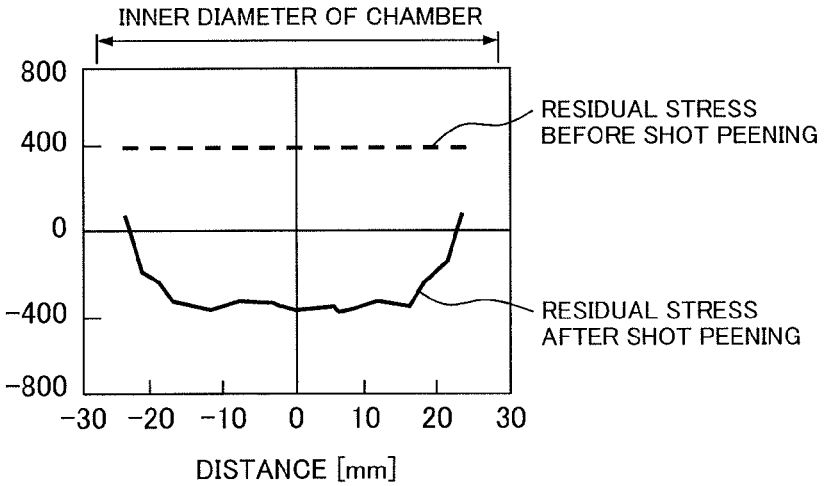
FIG. 19 is an explanatory drawing showing an effect of stress improvement in a structural member applied with a method of executing shot peening according to embodiment 8 shown in FIG. 16.

In order to check the compressive residual stress given to the inner surface of the weld portion of the V1 weld line of the core shroud by the method of executing shot peening according to the present embodiment, the inventors executed the shot peening as described above using the shot peening apparatus 1E for a surface of a flat test piece made of SUS316L simulating the form of the weld portion of the V1 weld line of the core shroud. This shot peening was executed while the test piece was immersed in water and the chamber 2 was pushed against the surface of the test piece in water. The test piece is a flat plate with dimensions of 200 mm by 200 mm by 10 mm in thickness. In the same manner as the flat test piece described in embodiment 1, the inventors applied grinding work to the surface of the test piece, for which the shot peening according to the present embodiment is to be executed, to give a tensile residual stress of 400 MPa shown in a broken line in FIG. 19. As a result of executing the method of executing shot peening according to the present embodiment described above using the shot peening apparatus 1E in water for the test piece, a compressive residual stress of approximately −400 MPa, as shown in a solid line in FIG. 19, can be given to the surface of the test piece in a range within a radius of 20 mm from the center of the chamber 2.

In this way, a tensile residual stress of 400 MPa before the execution of the shot peening according to the present embodiment can be improved to a compressive residual stress of about −400 MPa on the inner surface of the weld portion of the V1 weld line, which is the peening object 11, by executing the shot peening according to the present embodiment.

The present embodiment can obtain each effect generated in embodiment 7.

REFERENCE SIGNS LIST

1, 1A, 1B, 1C, 1D, 1E: shot peening apparatus, 2, 2A, 2B: chamber, 4, 4*b*: shot, 4*c*: ice particle, 5: pure water: 6A, 6B: jet generation apparatus, 6*a*: rotary vane, 6*c*: electric motor, 8: mesh, 10: makeup water supply pipe, 11, 11A, 11B, 11C, 11D: peening object, 12: fillet weld portion, 12A: weld portion, 14: ice-making apparatus, 16: air motor, 18: water jet motor, 19: impeller, 20: casing, 21: driving water supply hose, 22: driving water drain hose, 27: filter apparatus, 29, 29A: division member, 30A, 30B: region.

What is claimed is:

1. A method for executing shot peening comprising steps of:

bringing an end portion of a chamber into contact with a surface of a peening object, said chamber containing water and a plurality of shots and having a rotary vane of a water jet generation apparatus disposed therein;

generating a water jet from the water in said chamber toward said surface of said peening object by rotating said rotary vane; and moving the plurality of shots in said chamber toward said surface of said peening object by said water jet and making said shots collide with said surface of said peening object.

2. The method for executing shot peening according to claim 1, further comprising:

installing a mesh having squares, each of which is smaller than said shots, inside said chamber in front of said rotary vane, and putting said shots in a region in said chamber closer to said peening object than the mesh.

3. The method for executing shot peening according to claim 1, wherein at least two kinds of shots having different sizes are used as said shots.

4. The method for executing shot peening according to claim 1, wherein ice particles are used as said shots.

5. The method for executing shot peening according to claim 1, further comprising removing contaminants peeled off from said surface of said peening object by said collision of said shots by a purification apparatus.

6. The method for executing shot peening according to claim 1, further comprising closing a shutter that is movably installed in said chamber to seal an open end portion of said chamber when said chamber is moved.

7. The method for executing shot peening according to claim 6, further comprising opening said shutter before said shots collide with said surface of said peening object.

8. The method for executing shot peening according to claim 1, further comprising:

performing said step of bringing said end portion of said chamber in contact with said surface of said peening object under an air atmosphere;

supplying the water into said chamber before rotating said rotary vane, said end portion of said chamber being in contact with said surface of said peening object; and generating the water jet in said chamber after supplying said water into said chamber.

9. The method for executing shot peening according to claim 1, further comprising:

moving said chamber while said surface of said peening object is exposed to the water; and bringing said end portion of said chamber into contact with said surface of said peening object in said water.

10. The method for executing shot peening according to claim 1, wherein any one of an electric motor, an air motor, and a water jet motor is used as a driving apparatus for rotating said rotary vane of said water jet generation apparatus.

* * * * *